US006036061A

United States Patent [19]

O'Donnell

[11] Patent Number: 6,036,061

[45] Date of Patent: Mar. 14, 2000

[54] RETAINER FOR BLANK OF SPLIT CAP

[76] Inventor: Thomas F. O'Donnell, P.O. Box 1411, Windham, Me. 04062

[21] Appl. No.: 09/067,539

[22] Filed: Apr. 27, 1998

[51] Int. Cl.[7] ..... B67D 3/00

[52] U.S. Cl. ..... 222/539; 215/276; 220/86.1; 220/375; 220/379; 222/482

[58] Field of Search ..... 220/86.1, 361, 220/363, 367.1, 369, 379, 375, 744; 222/482, 538, 539, 543; 215/274, 276, 305, 399, 329, 295; 138/89

[56] References Cited

U.S. PATENT DOCUMENTS

| | | | |
|---|---|---|---|
| D. 301,689 | 6/1989 | Fick et al. | D9/524 |
| 1,426,846 | 8/1922 | Craig | 222/482 X |
| 1,808,784 | 6/1931 | Ocasek | 215/276 |
| 2,684,181 | 7/1954 | Neuner . | |
| 4,426,027 | 1/1984 | Maynard, Jr. | 222/529 |
| 4,595,130 | 6/1986 | Berney . | |
| 4,640,446 | 2/1987 | Walker | 222/539 X |
| 4,669,641 | 6/1987 | Holmes | 220/375 X |
| 4,811,865 | 3/1989 | Mueller, Jr. et al. . | |
| 4,867,337 | 9/1989 | Eichenseer . | |
| 5,056,424 | 10/1991 | Lai | 220/379 X |
| 5,328,043 | 7/1994 | Ray | 220/379 X |
| 5,400,928 | 3/1995 | Resnick . | |

FOREIGN PATENT DOCUMENTS

| | | | |
|---|---|---|---|
| 1295540 | 7/1919 | United Kingdom | 215/276 |

OTHER PUBLICATIONS 2 pages from Rubbermaid catalog, Sep. 1995.

*Primary Examiner*—Allan N. Shoap
*Assistant Examiner*—Joe Merek
*Attorney, Agent, or Firm*—Pierce Atwood; Chris A. Caseiro

[57] ABSTRACT

A device for retaining the blank or sealing lid of a split cap used to cap a fluid container having an invertible spout. The device includes various means for ensuring that the blank will be retained in close proximity to the user so that it will not be lost. This is achieved by modifying the blank either to enable affixing it directly to the container, or to configure it to be easily attached to a site close to the container. The retaining device includes a threaded section affixed to the blank for coupling the blank to the standard vent port of a container. Optionally, the retaining device includes a tethering hole located in the gripping flange of the blank to enable tethering of the blank to the container or to a shop hanger. Alternative designs of the retaining device include placing attachment devices on the underside of the blank and on the container, such as hook-and-loop couplings, male/female nipple sets, and magnetized components. The container may also be modified to include a pocket for stowing of the blank.

6 Claims, 5 Drawing Sheets

RETAINER FOR BLANK OF SPLIT CAP

BACKGROUND OF THE INVENTION

1. Technical Field

The present invention relates to split caps of the type including a retaining ring and a blank used to cover the opening of a container having a reversible or invertible spout or nozzle. More particularly, the present invention relates to means for retaining or otherwise coupling the blank to the container so that the blank cannot be lost.

2. Description of the Prior Art

Portable fuel containers are of great value to anyone who must operate any sort of fuel-powered equipment—lawn mowers, chain saws, etc. There are a wide variety of such containers, ranging in size from one gallon to five gallons or more in capacity. They are convenient in that they enable the user to move fuel from a fixed fuel tank—such as at a gas station—to a remote site where the equipment is to be used.

Many of the portable fuel containers in use and commercially available are made of plastics that are relatively lightweight and that are fuel resistant. Most of the containers that are available have a fuel fill port, which is the port for fuel inlet as well as fuel outlet, and a vent port. The vent port is designed to provide suitable atmospheric pressure to ensure that fuel will flow out of the fill port. There is generally a vent port cap secured to the body of the container to retain the vent port cap when the container is to be vented.

The fill port also comes with a cap. Some caps are simply molded unitary pieces that may be screwed onto a threaded exterior of the fill port. When fuel is to be introduced into the container—or poured out of the container—the unitary cap and the vent port cap are removed and the fuel is poured into or out of the fill port. Unfortunately, there is considerable spillage in such an operation as the fill port tends to be fairly wide and therefore induces splashing. Further, the container is ordinarily needed to fill relatively small fill holes of fuel-powered equipment. Doing so would be difficult without some sort of spout.

In order to overcome this problem, many containers have been produced to include a fuel nozzle having an outlet with a diameter smaller than the diameter of the fill port, and a base that is designed to rest on the perimeter of the fill port when deployed. The base is essentially a flange with an interior opening substantially of the same dimensions as the inside diameter of the fill port.

While the nozzle improves the flow of fuel out of the container, it cannot be used to fill the container. Therefore, reversible or invertible nozzles (spouts) have been developed and added to fuel containers. The invertible nozzle is designed to be inserted into the container nozzle outlet first when the container is not in use. The flange of the base of the nozzle rests on the fill port wall so that the nozzle will not fall into the container. The nozzle is removed from the container when the container is to be filled by withdrawing it from within the container. The nozzle is deployed for use by taking it out of the container, and inverting it such that the nozzle outlet is facing outwardly away from the tank, with the base again resting on the fill port of the container. Through this design, a suitable fuel nozzle can be used and then stowed out of the way when it is not in use.

In order for the container with invertible spout to work properly, it is necessary to have a two-part split cap to seal the container fill port under all conditions. The split cap covers the fill port through which the fuel (or any other fluid being transferred to or from the container) enters and exits the container. The split cap includes two pieces: a sealing disk—generally known as a "blank"—and an annular retaining ring or apertured cap that is generally coupled to the outside of the fill port. The retaining ring is designed to capture the blank and force it into contact with the flange of the base of the nozzle when the nozzle is inside the container and the container is to be closed. The blank thereby aids in sealingly closing the container. It also provides an alignment mechanism. The retaining ring includes a perimeter lip or flange that is the means for sealingly trapping the blank to the fill port perimeter. The ring flange also captures or traps the flange of the nozzle's base against the fill port perimeter when the nozzle is within the container and, more importantly, when the nozzle is deployed for fluid delivery. Since the retaining ring is annular, the nozzle can pass through it. However, when the nozzle is not in use, the blank must be used in order to ensure that fluid will not come out of the fill port by way of the retaining ring's annulus. It is important, then, that the blank always be available to completely seal the container when the nozzle is not deployed.

Unfortunately, for most of the portable containers in use that include a split cap, the blank is fairly small and can easily be misplaced or displaced. As a result, it is quite common to lose them. This prevents the user from ensuring a sealing closure of the container when desired. When blanks are lost, there is a tendency to leave the nozzle in place and either let fluid splash out of it, or, more commonly, stuff a rag into the nozzle outlet to prevent fluid from escaping. Of course, this sets up a terribly dangerous condition when the fluid is a combustible one. Means for ensuring that the blank is kept proximate to the retaining ring would therefore be useful. Unfortunately, the split-cap containers that have been and are available are not tethered to any other component of the container, or, for that matter, to the container itself.

Several designs have been disclosed that apparently aid in keeping a fluid container closed. U.S. Pat. No. 4,595,130 issued to Berney describes the problems associated with the split-cap design in a reversible-spout container. However, rather than make suitable modifications to the cap supplied with the container, Berney created a completely different cap and nozzle assembly. In particular, Berney provides a second unitary cap that closes the container's fill port when the spout is within the container and a different and a re-designed nozzle that eliminates the need for the retaining ring. The second cap is tethered to the container at the base of the fill port. Berney provides a rather expensive fix to the problem of a lost blank by creating a new nozzle and a new cap.

U.S. Pat. No. 4,811,865 issued to Mueller, Jr. et al. is also for a gas can having an invertible spout. The container includes an apertured cap but apparently without a blank for sealing of the container when the nozzle is within the container. Instead, a cap is used to cover the nozzle outlet when the container is not in use—whether the nozzle is deployed for fluid flow or when it is inverted within the container. The Mueller design is not specifically related to a split-cap design but does show the attempts made to address the problems associated with the stowable spout.

U.S. Pat. No. 5,400,928 issued to Resnick describes a supplemental device for storing a nozzle of a container. There is included means for retaining a unitary cap to the container, but Resnick fails to address the problem of retaining the blank of a split cap of the type commonly available and widely used. U.S. Pat. No. 2,597,593 issued to Neuner describes a type of invertible spout but fails to address the problems specifically related to loss of the blank of a split-cap design.

Therefore, what is needed is a modified split cap assembly designed to make it easy for a user to retain the blank when the nozzle is deployed. What is also needed is a modified split cap assembly that is designed to conform with the design of the original container and invertible spout so as to minimize the expense associated with ensuring that the blank will not be lost.

SUMMARY OF THE INVENTION

It is an object of the present invention to provide a modified split cap assembly designed to make it easy for a user to retain the blank when the nozzle is deployed from a container including the split cap. It is also an object of the present invention to provide a modified cap assembly that is designed to conform with the design of the original container and invertible spout.

These and other objectives are achieved in the present invention through the introduction of a modified blank and one or more slight modifications to the container. The blank of the split cap of the present invention includes an adaptive coupling means for fixing the blank to the container body or a container appendage. It is contemplated that various design modifications of the blank will enable a container user to tether or otherwise retain the blank to the container.

It is important to note that the present invention is limited to split or apertured cap assemblies for fluid containers. In that regard, the sealing disk or blank can never be permanently tethered to the container, as may be the case with some cap tethering devices of the prior art. Therefore, alternative means for stowing the blank must be considered. As earlier noted, in the past, failure to provide such stowage capability commonly leads to loss of the blank.

One blank design of the present invention that is of particular interest includes a threaded portion to allow the user to screw the blank onto the threads of the vent port when the spout is in use. It is important to note that this design requires that such threading conform with the existing container design. That is, since the inside threads of the apertured cap (retaining ring) must fit the outside threads of the fill port, and the spout body must fit within the fill port, then the threaded portion of the modified blank of the present invention must be sized to ensure that the spout body will continue to fit within the fill port neck. In addition, it is preferable that the threaded portion of the modified blank conform with the outside threading of the vent port. Therefore, the modified threaded portion of the blank is located on the underside of the blank—that portion residing within the fill port when the spout is not in use—with an outside diameter smaller than the inside diameter of the spout body proximate to its base. The modified threaded portion also has inside threading that fits the vent port's outside threading. In this way, the blank may easily be stowed on the container when the spout is in use without completely sealing off the venting of the container. Sealing of the vent port does not occur due to the fact that there is considerable spacing between the threaded portions threads and the partial outside threads of the vent port.

The existing gripping flange of the presently-available blanks is used to permit holding of the blank and which extends above the surface of the retaining ring when the blank is in place. It may also be modified to include a tethering hole. A tether may be linked to the tethering hole and to either a workshop hanger or to a threadless hole available on the external surface of the retaining ring of many split cap assemblies. The tether would also serve the dual purpose of being a handle for the blank of the present invention. Making the blank with a modified threaded section to permit coupling to existing vent ports, and/or the introduction of a tethering hole, permits coupling of the blank to the container without any modifications to the container.

Alternative blank retaining means of the present invention may readily be built into existing blanks and only require minimal modifications to commercially-available containers. One such alternative involves creating a recessed or exposed pocket in the body of the container, which pocket is designed to yield a tight fit of the blank therein. Another alternative includes the introduction of a fuel-resistant hook-and-loop surface to the blank and a corresponding hook-and-loop section to the surface of the container. Velcro (TM) would be a suitable material easily affixable to both the blank and the container. Additionally, other means for retaining the blank to the container include the introduction of a male nipple to the blank, with a corresponding female receiver formed in the surface of the container. Of course, the blank may be made with the female design and the container with the male nipple. Another means for retaining the blank is the application of a sealed magnet to both the blank and the container so that the user could easily join the two together simply by placing them in close proximity to one another.

These and other designs and advantages of the present invention will become apparent upon review of the submitted drawings, the detailed description of the device, and the appended claims.

DETAILED DESCRIPTION OF THE PREFERRED EMBODIMENTS OF THE PRESENT INVENTION

Figure 1:
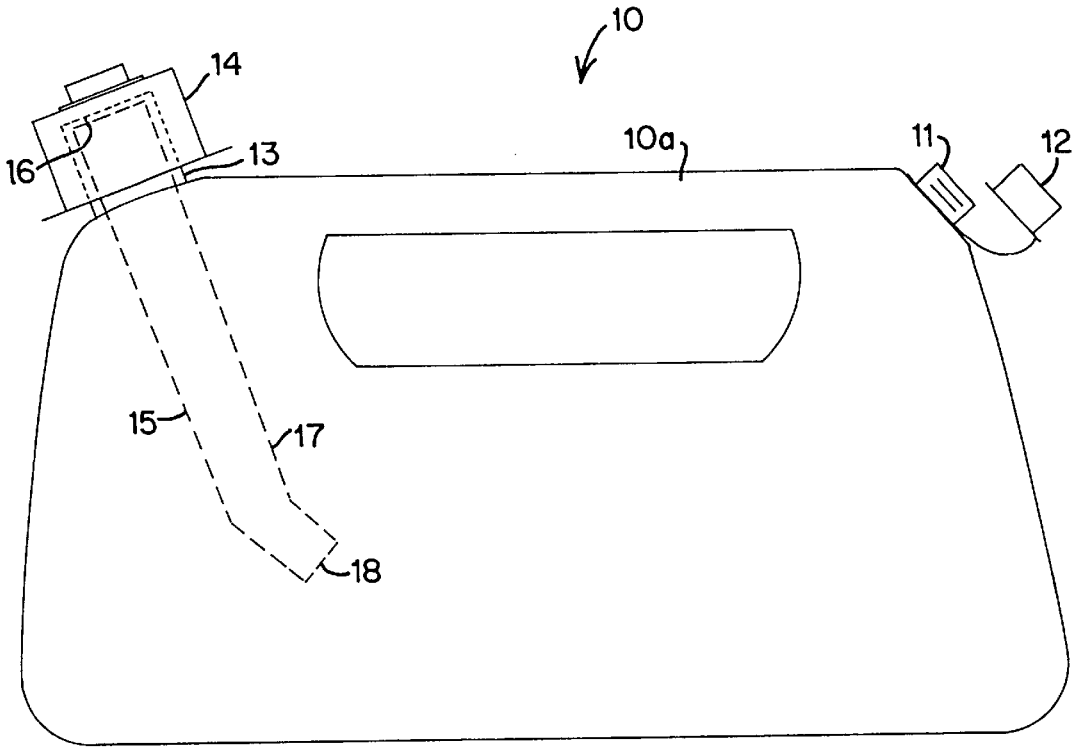
FIG 1 (PRIOR ART)
FIG. 1 shows a simplified side view of a prior-art fluid container including an invertible spout in the stowed position, a split cap, and a vent port with tethered cap.
Figure 2:
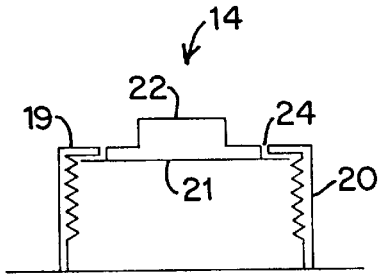
FIG 2 (PRIOR ART)
FIG. 2 shows a simplified side view of the prior-art split cap.
Figure 3:
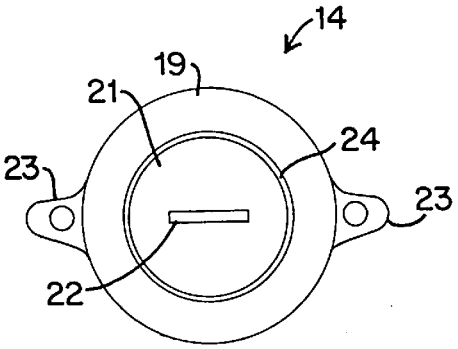
FIG 3 (PRIOR ART)
FIG. 3 shows a simplified top view of the prior-art split cap shown in FIG. 2.
Figure 4:
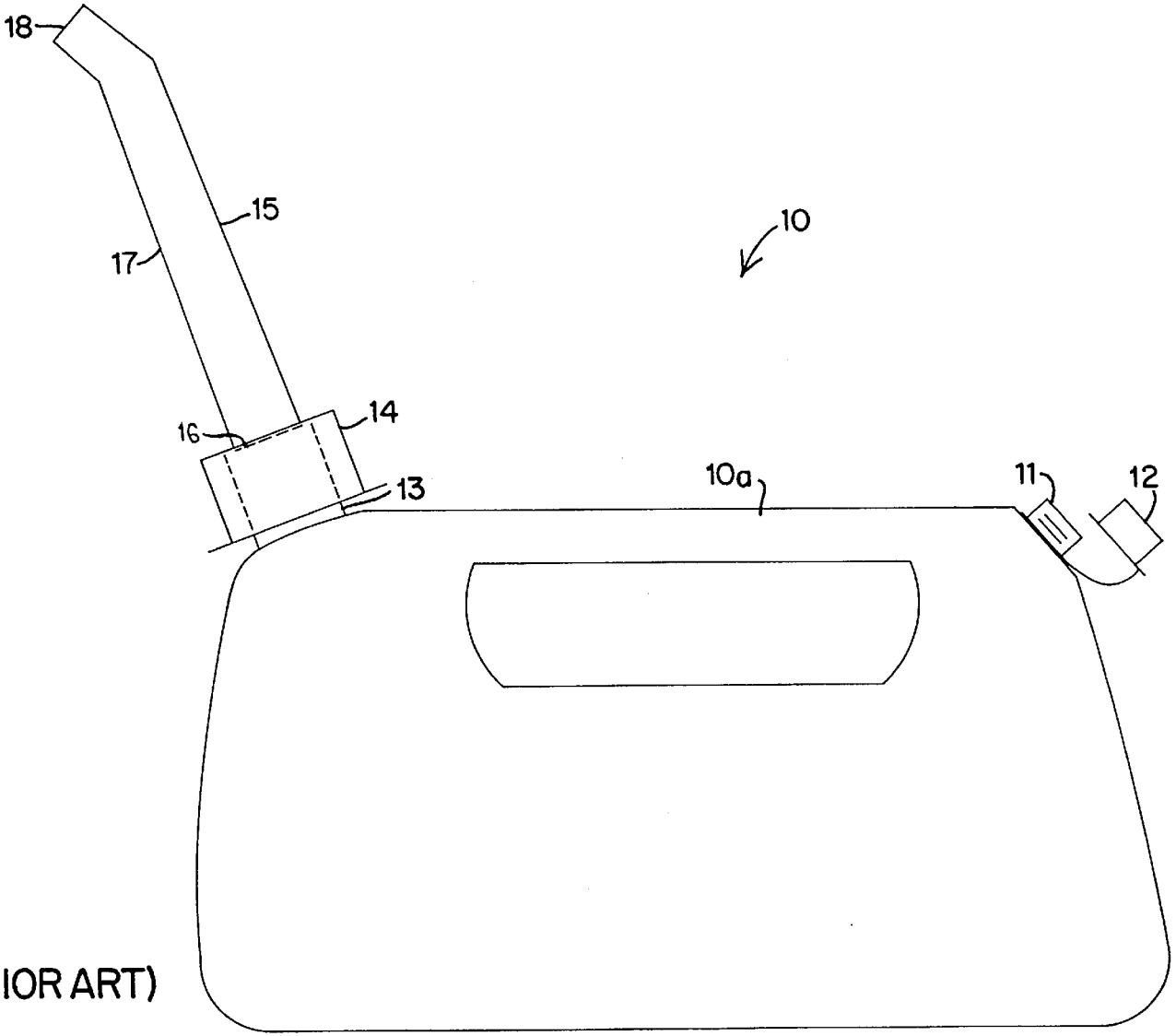
FIG 4 (PRIOR ART)
FIG. 4 shows a simplified side view of a prior-art fluid container including an invertible spout in the exposed position, a split cap, and a vent port with tethered cap.

FIG. 1 illustrates a prior-art fluid container 10 including an easy-carry handle 10*a,* a vent port 11 with vent port cap 12, a fill port 13 with a split cap 14 for sealing the fill port 13, and an invertible spout 15 in the stowed position. The spout 15 includes a base 16 and a spout body 17 with spout nozzle 18. As illustrated in FIGS. 2 and 3, the split cap 14 of the prior art includes a retaining ring 19 with interior cap threading 20, and a blank 21. The blank 21 typically includes a gripping flange 22 to aid a user in moving the blank 21. The retaining ring 19 may also include tethering appendages 23. As can be seen, the split cap 14 is formed of two separable pieces, the retaining ring 19 and the blank 21. The retaining ring 19 is designed to capture the blank 21 within a retaining ring aperture 24 by threading the interior cap threading 20 onto outside threading of the fill port 13. When the retaining ring 19 is unthreaded from the outside threading of the fill port 13, and the blank 21 is removed, the spout 15 may be exposed. The spout body 17 extends through the ring aperture 24, with the base 16 resting on the perimeter of the upper surface of the fill port 13, as shown in FIG. 4. The retaining ring 19, minus the blank 21, is then screwed back onto the fill port threading, thereby sealingly trapping the spout base 16 on the lip of the fill port 13. The container 10 is then ready to be used to transfer fluid from within the container 10.

Figures 5, 6, 7, 8, 9:
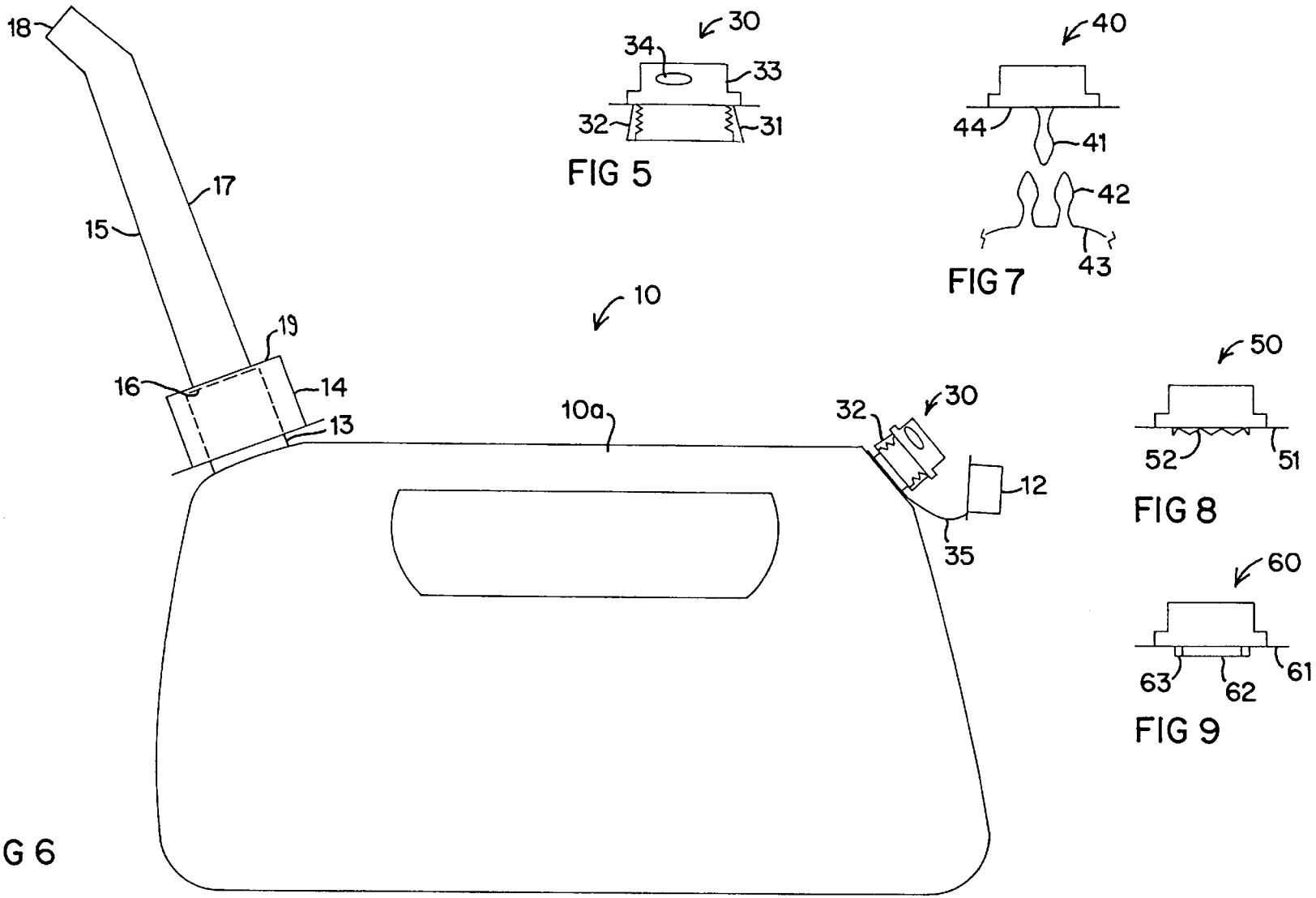
FIG. 5 shows a first embodiment of the modified blank of the present invention.
FIG. 6 shows a simplified side view of a fluid container including the modified blank of the present invention shown in FIG. 5, with the modified blank stowed on the vent port.
FIG. 7 show s a second embodiment of the modified blank of the present invention as couplable to a modified section of a fluid container body.
FIG. 8 shows a third embodiment of the modified blank of the present invention.
FIG. 9 shows a fourth embodiment of the modified blank of the present invention.
Figure 6A:
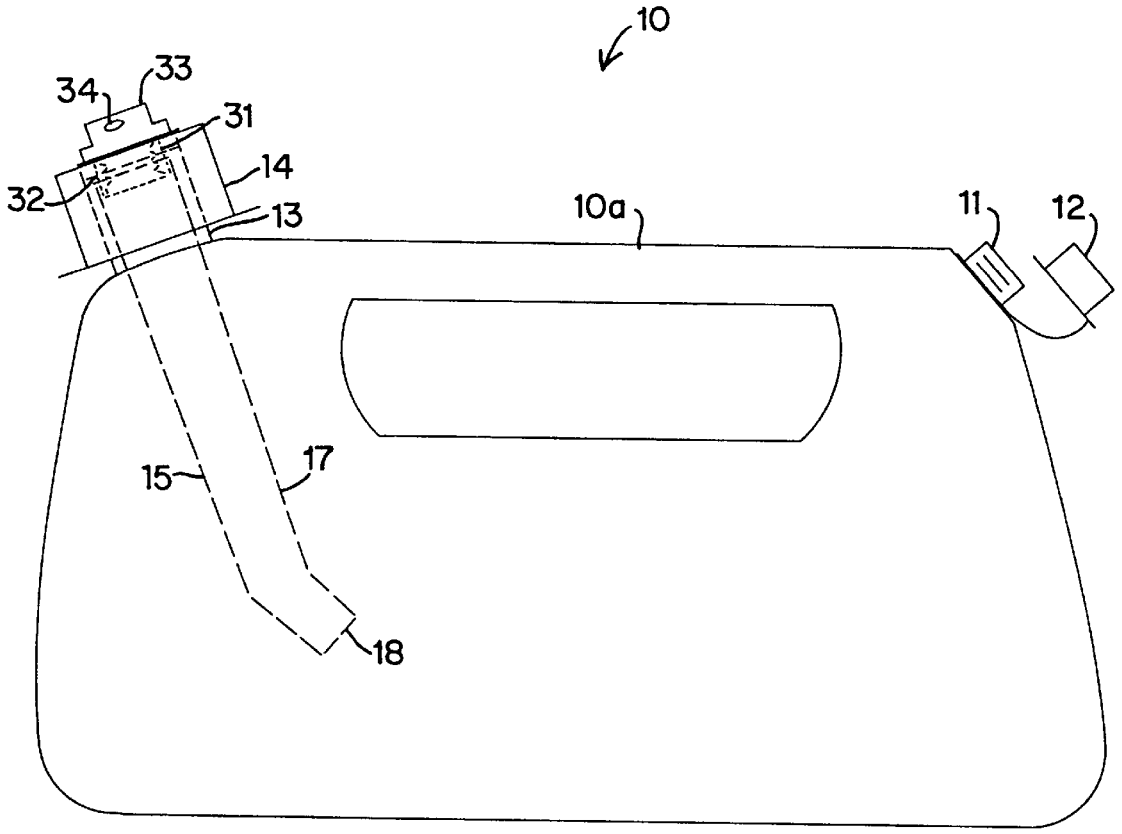
FIG. 6*a* shows a simplified view of the container showing the modified blank of FIG. 5 and the invertible spout retained therein.

The present invention involves the modification of the prior-art blank 21 and/or the body of the container 10 so as to provide means for retaining the blank proximate to the container 10 so that it will not be lost. The embodiment of a first modified blank 30 of the present invention is shown in isolation in FIG. 5 and as coupled to the container 10 in FIG. 6. The first modified blank 30 includes a threaded blank section 31 including an interior threaded portion 32 designed to match threading of the existing outside threading of the vent port 11. Additionally, in order to ensure that the first modified blank 30 will fit into the ring aperture 24 and will not interfere with the stowing of the spout 15 within the fill port 13, the outside dimensions of the threaded blank section 31 are designed not to exceed the outside dimensions of the spout body 17, particularly near the spout base 16 as shown in FIG. 6A. The threaded blank section 31 is designed to create a venting gap between the blank 30 and the threads of the vent port 11 so that the vent port 11 may continue to perform its function of providing equalizing pressure within the container 10 when the first modified blank 30 is loosely threaded onto the vent port 11, which itself typically includes only partial threading to aid in the venting effect.

The first modified blank 30 may optionally include an adapted flange 33 having a tether hole 34 for the introduction of a tether. The tether may be substantially the same as the type of tether 35 found for tethered vent hole caps 12. The tether hole 34 may be used to tether the first modified blank 30 to either one of the tethering appendages 23 of the retaining ring 19. It may also be used to tether the blank 30 to a workshop hook or to an adaptive section of the container 10.

The remaining improved blank designs described herein include some small modifications to the container body as part of the blank retaining means. As illustrated in FIG. 7, a second modified blank 40 includes a male coupling nipple 41 designed to be captured by a pair of female coupling nipples 42 preferably formed in a modified container body section 43. This design permits the user to easily stow the second modified blank 40 directly on the modified container body 43. Alternatively, the male coupling nipple 41 may be formed in the modified container body section 43 while the pair of female coupling nipples 42 are fabricated as part of an underside 44 of the second modified blank 40. As with the first modified blank 30, it is important to ensure that the dimensions of any protuberances of the modified underside 44 not exceed the outside diameter of the spout body 17.

FIG. 8 illustrates a third modified blank 50 having a modified underside 51 including a coupling surface 52 preferably made of a hook-and-loop material such as Velcro (TM). It is to be understood that the exterior surface of the container 10 must similarly include a corresponding hook-and-loop material. FIG. 9 illustrates a fourth modified blank 60 having a modified underside 61 including a coupling surface 62 that is a non-metallic casing with a magnet 63 positioned therein. The magnet 63 must be encased or otherwise isolated so as to eliminate the possibility of static charging that could lead to sparking, particularly when the fluid within the container 10 is combustible. It is to be understood that the exterior surface of the container 10 must include a magnetically-attractive material that is also preferably encased.

Figure 10:
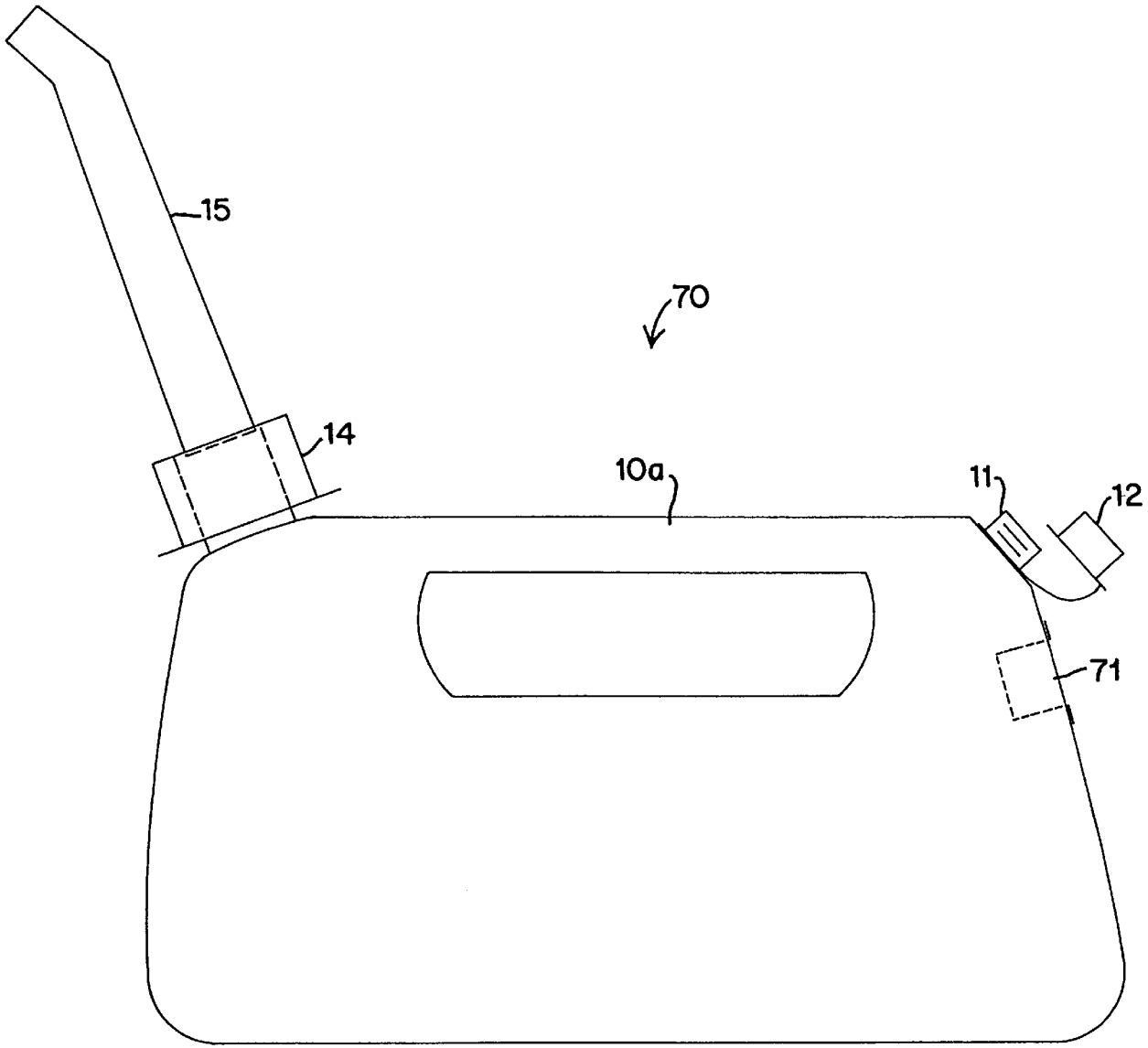
FIG. 10 shows a modified container body including a blank-holding pocket.

Finally, the blank retaining means of the present invention may alternatively involve the modification of the container alone. As illustrated in FIG. 10, a modified container 70 of the present invention includes a recessed pocket 71 molded or otherwise formed therein. The blank 21 may be placed within the pocket 71 when the spout 15 is exposed. The pocket 71 is preferably designed to ensure a tight fit of the blank 21 therein.

Although the preferred embodiments of the present invention have been described herein, it is to be understood that the above descriptions are merely illustrative. Other means and methods may be substituted for particular features and processes without deviating from the blank retaining means described herein. Accordingly, it is to be understood that the present invention is not limited to that precisely shown and described.

I claim:

1. A fluid container combination comprising:

a. a fluid container having a fill port with an upper surface thereof;

b. an invertible spout having a spout base and a spout body, wherein said spout base is designed to be in sealing engagement with said upper surface of said fill port and said spout body is designed to fit within said fill port and an interior of said fluid container when in an inverted position;

c. a split cap for sealing said fill port of said container, wherein said split cap includes a retaining ring for retaining said spout base in sealing engagement with said upper surface of said fill port, said retaining ring having inside threading for coupling to outside threading of said fill port; and d. a sealing closure having a gripping flange for movement of said sealing closure, and a sealing closure attachment means for detachably connecting said sealing closure to said fluid container, wherein said sealing closure is retainable by said retaining ring on said upper surface of said fill port, and wherein said sealing closure attachment means is designed to fit within said fill port below said upper surface of said fill port without interfering with stowage of said invertible spout, and wherein said sealing closure includes an underside positionable within said fill port and an upper surface including said gripping flange exposed to the atmosphere when said retaining ring retains said invertible spout in said inverted position within said fluid container.

2. The combination as claimed in claim 1 wherein said fluid container includes a vent port, said sealing closure attachment means comprising a threaded section, wherein inside threading of said threaded section is designed to couple said sealing closure to outside threading of said vent port, and wherein outside dimensions of said threaded section are smaller than inside dimensions of said spout body.

3. The combination as claimed in claim 2 wherein said gripping flange includes a tethering hole formed therein, wherein said tethering hole is designed to be coupled to a tether for linking said sealing closure to said container or to said retaining ring.

4. The split cap as claimed in claim 1 wherein said blank retaining means includes a male nipple affixed to said underside of said blank and a pair of opposing female coupling nipples affixed to a body of the container.

5. The split cap as claimed in claim 1 wherein said blank retaining means includes a first hook-and-loop section affixed to said underside of said blank and a second hook-and-loop section affixed to a body of the container.

6. The split cap as claimed in claim 1 wherein said blank retaining means includes a magnetic material encased within an insulative material affixed to said underside of said blank and a magnetically-attractive material affixed to a body of the container.

* * * * *